US005526244A

United States Patent [19]

Bishop

[11] Patent Number: 5,526,244

[45] Date of Patent: Jun. 11, 1996

[54] OVERHEAD LUMINAIRE

[76] Inventor: Vernon R. Bishop, 630 Peachdale La., Duncansville, Pa. 16635

[21] Appl. No.: 64,924

[22] Filed: May 24, 1993

[51] Int. Cl.[6] ..... F21S 3/02

[52] U.S. Cl. ..... 362/147; 362/221; 362/290; 362/354; 362/404

[58] Field of Search ..... 362/147, 216, 362/219, 221, 263, 290, 342, 354, 404, 277, 319, 307

[56] References Cited

U.S. PATENT DOCUMENTS

| | | | |
|---|---|---|---|
| 1,965,170 | 7/1934 | Benjamin . | |
| 2,305,723 | 12/1942 | Livers . | |
| 2,531,232 | 11/1950 | Naysmith . | |
| 2,543,713 | 2/1951 | Yeager | 362/216 |
| 2,630,520 | 3/1953 | McDaid . | |
| 2,762,598 | 9/1956 | Runge | 362/404 |
| 2,795,692 | 6/1957 | Lemmers | 362/221 |
| 2,951,611 | 9/1960 | Tillson et al. | 362/221 |
| 3,436,537 | 4/1969 | Bostonian . | |
| 3,619,602 | 11/1971 | Wilde . | |
| 3,752,977 | 8/1973 | Davis . | |
| 4,464,707 | 8/1984 | Forrest . | |
| 4,691,267 | 9/1987 | Giesberg . | |
| 4,814,958 | 3/1989 | Hsieh | 362/277 |
| 4,833,575 | 5/1989 | Hamilton | 362/307 |
| 4,841,418 | 6/1989 | Davis . | |
| 4,924,147 | 5/1990 | Rensch . | |
| 4,958,267 | 9/1990 | Baake . | |
| 4,999,748 | 3/1991 | Aoshika | 362/277 |
| 5,025,356 | 6/1991 | Gawad . | |

FOREIGN PATENT DOCUMENTS

| | | | |
|---|---|---|---|
| 819561 | 7/1949 | Germany | 362/219 |

OTHER PUBLICATIONS

GE Biax Lamps Ballast & Luminaire Application Information pp. 21,22,23.

Sylvania Flourescent Lamps to fit your needs 1 page.

*Primary Examiner*—Ira S. Lazarus
*Assistant Examiner*—Sara Sachie Raab
*Attorney, Agent, or Firm*—Clyde I. Coughenour

[57] ABSTRACT

A fluorescent luminaire, of the suspended overhead type, is constructed with the lamps of the "U" type having both electrical connections at the same end so that the lamp forms a cantilever suspension from a central housing. The ballast means is formed perpendicular to the lamps and placed in the central housing to concentrate the weight there and separate the heat-generated there from that generated by the lamps. Translucent/reflector sections and baffle means extending from the central housing are made of a light-weight plastic material. To assist in starting the lamps and for support, a metallic reflector or support extends adjacent to and parallel to the lamps and is grounded at or within the central housing. The reflector/translucent means and lamps are arranged so as to eliminate bright and/or dark spots.

20 Claims, 2 Drawing Sheets

FIG. 1
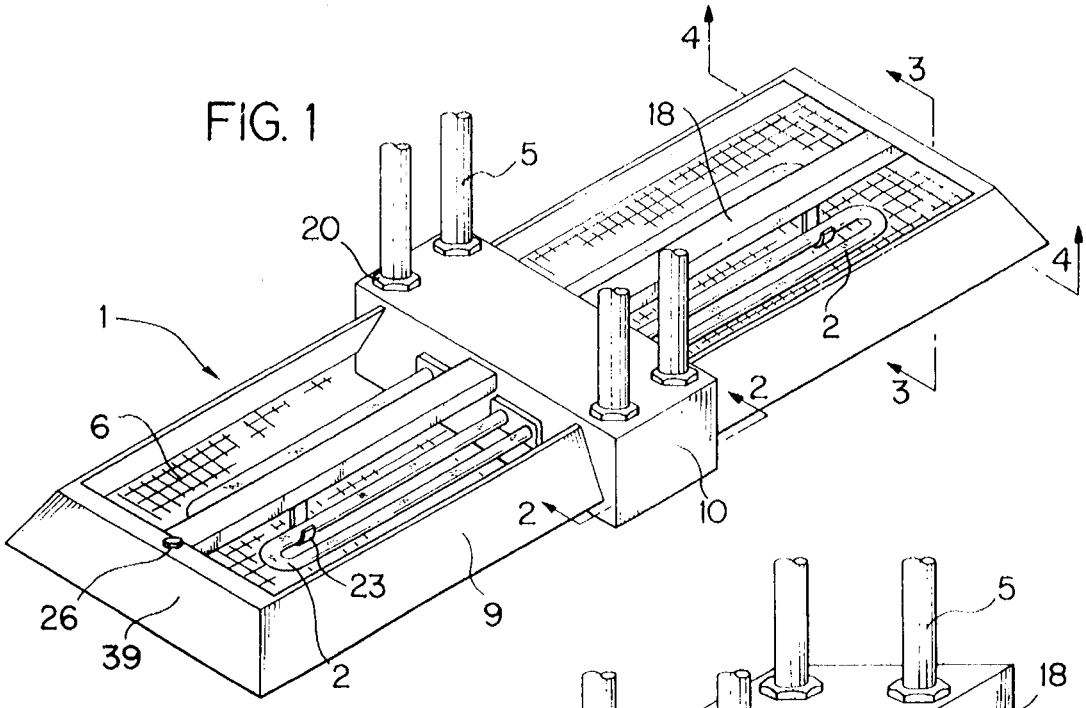
FIG. 2
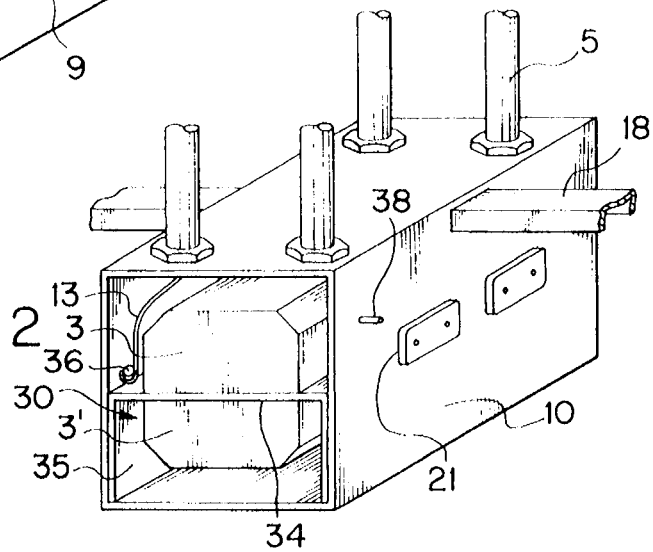
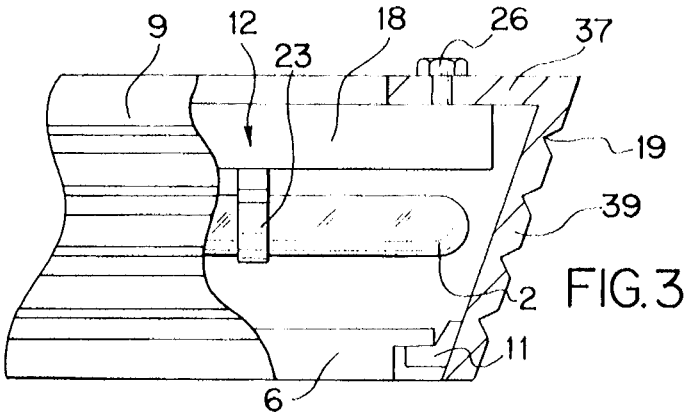
FIG. 3

OVERHEAD LUMINAIRE

BACKGROUND OF THE INVENTION

1. Field of the Invention

An overhead fluorescent lighting fixture has a central housing enclosing the ballast. The longitudinal axis of the ballast extends perpendicular to cantileverly supported lamps. The lamps are bent so as to have both the electrical end connections on the same end and are attached by way of a lamp holder to the central housing. A plastic translucent and reflective shade assists light control. A grounded metallic reflecting support is secured to the central housing and extends outwardly above and parallel to the lamps to assist lamp start-up and to support the free ends of the lamps and the lamp shades.

2. Description of Related Art

Fluorescent lamps have been popular for most of the 20th Century, since their appearance at the 1939 World's Fair in New York. Most lighting fixtures in use are metal boxes recessed within the ceiling, or are mounted to the ceiling surface, or are suspended by way of pipes, chains or cables from the ceiling. Suspended luminaires are routinely supported at both ends. It is standard practice to have these lamps bent into a "U" shape or straight with electrical attachments on opposite ends. The lamps are usually parallel to the ballast that runs alongside, between or above the lamps. Suspended luminaires usually use aluminum extrusions or sheet metal as the framework and have reflector means that run the length of the lamps. These luminaires provide up-light and/or down-light to illuminate both the ceiling above and/or the surfaces below. The opaque metal housings usually cast objectionable dark shadows, particularly so against the lighted ceiling. The use of "U" shape lamps with the electrical connections at the same end, for cantilever type support, is old as shown by R. Benjamin in U.S. Pat. No. 1,965,170, issued Jul. 3, 1934, and D. Davis in U.S. Pat. No. 4,841,418, issued Jun. 20, 1989, and K. Baake in U.S. Pat. No. 4,958,267, issued Sep. 18, 1990. In the past it has been proposed to have the ballast located remotely from the lamps, U.S. Pat. No. 2,305,723, issued Dec. 22, 1942 to J. F. Livers, and U.S. Pat. No. 2,630,520, issued Mar. 3, 1953 to N. J. McDaid; and to have the ballast located near the lamps but in a separate housing, U.S. Pat. Nos. 2,531,232, issued Nov. 21, 1950 to S. R. Naysmith, and 3,619,602, issued Nov. 9, 1971 to L. G. Wilde; and that the ballast need not be parallel to the lamps, U.S. Pat. No. 3,752,977, issued Aug. 14, 1973 to R. W. Davis, and U.S. Pat. No. 4,958,267, issued Sep. 18, 1990 to K. A. Baake; and that a heat sink may be used to dissipate the heat generated by the ballast, U.S. Pat. No. 4,691,267, issued Sep. 1, 1987 to J. Giesberg, and U.S. Pat. No. 5,025,356, issued Jun. 18, 1991 to M. A. Gawad.

SUMMARY OF THE INVENTION

The light projected onto any given area is exponentially reduced as the distance from the light source increases. To reduce this distance, lamp fixtures, usually made primarily from metals, have been suspended from ceilings to be closer to the area illuminated. This invention improves over the prior lamp fixtures by suspending the fixture by four suspension supports that have threaded ends that can be adjusted to level and/or to position the lamps with respect to the ceiling or floor. The ballast means are positioned perpendicular to the lamps in a central metallic housing to concentrate the lamp fixture weight in a central location under the suspension supports. The lamps are of the "U" shape type so that the lamp sockets and electrical wiring and circuitry means are all a part of the central housing. Only lightweight materials are extended beyond the central housing, with the exception of relatively narrow elongated metallic strut support means. As the ferrous support means is the only metal necessary beyond the central housing, the lamps and light control and diffusion means are arranged so that all areas around the lamp fixture receive enough light to eliminate undesirable light and dark spots often associated with most lamp fixtures. By having the ballast means located within the central housing, the heat generated by it is concentrated within the housing and can be conducted to the housing and dispensed into the surrounding area by air circulation around the housing. The light reflection and dispersion means, supported by the central housing in cantilever fashion, are arranged, at the time of manufacture, to project or concentrate the light in select areas.

BRIEF DESCRIPTION OF THE DRAWINGS

FIG. 1 is a perspective view of a preferred lighting fixture of the invention.

FIG. 2 is a partial perspective sectional view taken essentially on the line 2—2 of FIG. 1.

FIG. 3 is a partial sectional side view taken essentially on the line 3—3 of FIG. 1 with a cutaway of the shade.

DETAILED DESCRIPTION OF THE PREFERRED EMBODIMENT

Figure 4:
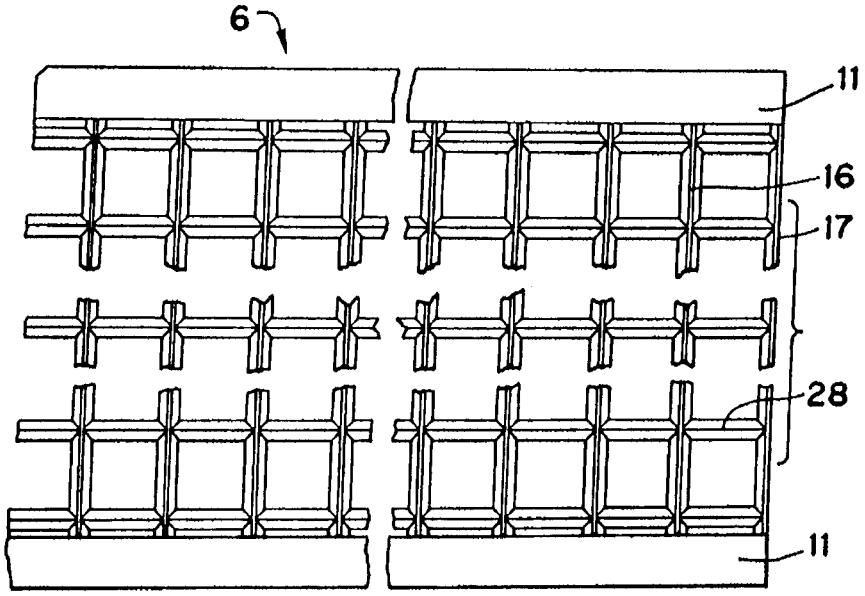
FIG. 4 is a partial bottom view of a baffle as shown on the line 4—4 of FIG. 1.

The present invention improves on the lighting fixtures of the prior art. The ballasts 3,3' are in a separate compartment or housing 10 at the center core of the lamp fixture 1 and perpendicular to the lamps. In this configuration the ballasts will operate cooler, as the heat from the ballasts is separate from and not added to that of the lamps 2. By separation of the ballast and lamps, the heat build-up in the lamp compartment is small enough to permit light diffusion means to be placed above the lamps without creating a safety hazard. By use of a separate centrally located compartment for the ballasts, the heaviest components of the fixture are immediately under the support means connecting them to the ceiling. Over one-half of the total weight of the lamp fixture is concentrated within the central metallic housing located directly under the supports.

The fluorescent lamps 2 used have both electrical connections at the same end. This permits a cantilever attachment and eliminates the need for the wiring to extend beyond the central core. One or two lamps are cantilevered outwardly from each side of the ballast compartment. This arrangement concentrates the weight directly under the support means, reducing the torque about the central support and balancing the moment about the central support.

A combination reflective translucent plastic material of various shapes surrounds a portion of the lamps, shielding them from normal viewing angles, and redirecting light out of the luminaire. A baffle 6 in the lower portion of the fixture controls and directs the down-light. One shade embodiment 9,39 is open at the top permitting some up and down unobstructed light. The shade 7 of another embodiment completely encompasses the top of the lamps. The shade luminosity eliminates strong contrasts between the fixture brightness and the brightness on the ceiling. The reflection and transmission or diffusion can be controlled. This can be done by selection of the material used or by its manufacture and shape or treatment. Different thickness shade materials can be used or a smooth mold surface can be used to make a highly transmissive surface with the amount of transmission reduced as desired by sanding the surface to increase reflectivity.

Figure 6:
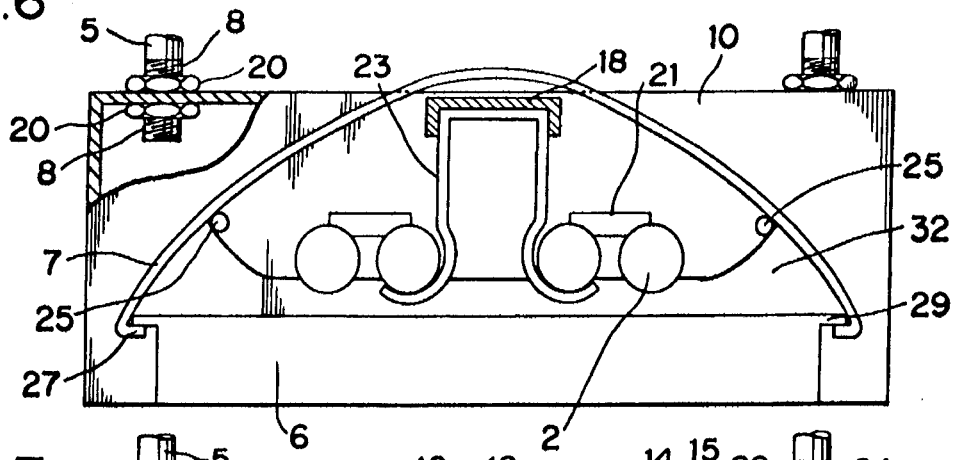
FIG. 6 is a transverse end sectional view of an alternate embodiment of the invention with a cutaway.
Figure 7:
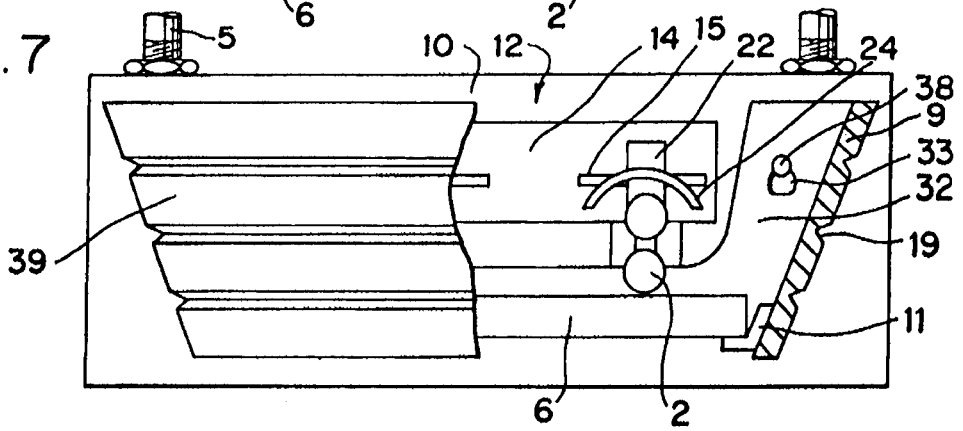
FIG. 7 is a transverse end view with a cutaway of another alternate embodiment of the invention.

The embodiments shown in FIGS. 1, 3, and 7 have an open top 12 with a baffle means 6 across the bottom and plastic translucent/reflector shade means 9,39 around the sides and ends. The metallic housing 10 isolates the ballast means 3,3' from the light emitting lamps 2 that are provided with electrical sockets or outlets 21 at the housing. The lamps 2 are shown attached or mounted horizontally or flat in FIGS. 1, 3 and 6. The lightweight baffle means 6 and shade means 9 are supported at the housing 10 and are provided with additional support at their outer ends by the reflective support or strut 18 and attachment means 26 that extends between the strut and shade flange 37. The outer ends of the lamps 2 are supported with clip means 23. A flange 11 is attached to the lower portion of shade 9 by adhesive or integrally molded to form the support for baffle means 6. The flange 11 is formed of a translucent plastic material to keep the weight down and to preclude opaque area formation in the shade. The preferred suspension for the light fixture from the ceiling, as shown in FIGS. 1 and 2, is to have four support stems 5 attached to the top of the metallic housing 10. As best shown in FIG. 6, by providing threaded end means 8 on each support stem 5, with adjusting nuts 20 on each to secure the housing onto the support stem bottoms, the housing 10 and light fixture 1 can be adjusted to be level and/or parallel to the ceiling.

As best seen in FIG. 2, the metallic housing 10 encloses the ballast means 3,3' electrical wiring and circuitry forming a part of the lamp fixture. While any convenient support for the ballast may be provided, it is preferred that the ballast be releasably secured so that it, and the electrical means within the housing, can be removed for inspection and maintenance. A bracket 30 has a horizontal section 34, and a vertical section 35 that is spot welded onto the housing for support, heat conduction and electrical conduction. This provides an appropriate ground for the various metallic components of the fixture. An electrical means can be connected between the metallic parts to assure electrical conductivity between the parts. This is shown in FIG. 2 by having a wire 13 attached to the bracket 30 with a fastener 36. With the ballast means 3,3' attached or fastened to a metal bracket 30 and the bracket to the metal housing by spot welding, the heat generated by the ballast means is readily conducted to the metal housing, that acts as a heat sink. The heat is then removed by free air circulation around the housing. With this arrangement the highest temperature encountered on the ballast has been 68° C. This is well below the 90° C. required to activate a thermal protector used inside the ballast means. The housing 10 is wider and longer than the ballast means 3,3' so as to leave an inch or two set back for access and wiring.

Lamps of the style used in this fixture need an aid for reliable starting. The normally used metal of a fluorescent lamp fixture, when electrically grounded, provides or acts as a sufficient starting aid. These heavy fixtures are of the type desired to be avoided. It has been found that a grounded metal strut adjacent the lamp, on any side, will provide the needed starting aid. The critical criteria for the aid is its extent and location. For best results, the metal aid should extend essentially the full length of the lamp and be spaced from ⅛ to 1 inch from the lamp. The starting aid should not touch the lamp.

For strength, a metal backbone or strut/reflector is extended in cantilever fashion from the central housing 10 along the major extent of the lamp and diffusion/reflector means 9. The strut may be welded, riveted or bolted to the housing 10. The attachment should provide an electrically conductive path between the parts. To assure electrical grounding, a ground wire can be connected to the housing, the strut and/or the bracket. A ground wire is routinely connected to the electrical system ground, to ground all the metal components of the luminaire, but a separate or additional ground means can be provided. The electrical ground for the housing can be provided by having a conduction path through the metal housing 10 and metal suspension 5 to an electrical ground in the ceiling support. The metal backbone or support may be in the form of a "U" shaped strut 18 as shown in FIGS. 1–3 and 6. This strut performs three basic functions. It supports and strengthens the cantilever section of the lighting fixture, when grounded it assists in lamp start-up, and it reflects light upwardly and downwardly out of the lighting fixture.

The shade means 9 are made of a lightweight plastic. The shades are preferably made by casting then thermoformed or machined into final shape. The as-cast material is quite shiny and has a glassy finish or appearance. In this condition, it is a good transmitter of light. It has been found that sanding the surface on either one or both surfaces results in a reduction of the amount of light transmitted and an increase in the amount of light that is reflected. By controlling the amount of sanding of the total shade or by varying the degree of sanding in different areas, aesthetic configurations can be attained or specific light transmission requirements may be provided. The side and end shade angle sections 9,39 are provided with diffusion grooves 19. These groove areas 19 provide for more and less translucent areas in the shade angle sections. The resulting contrasts in brightness add both light diffusion and a decorative appeal to the fixture. It is preferred that the shade side and end sections slope upwardly and outwardly at about a 20 to 30 degree angle from the vertical as essentially shown in FIG. 3.

The shade can be provided with a back plate that butts up against the housing. The shade can be attached directly to the housing for support and location by any common means. The shade is shown in FIGS. 6 and 7 with a back plate 32 provided with apertures 33 that can be held with a bolt means 38 to support and/or clamp the shade to the housing or simply to locate it on the housing. The securing and/or positioning means, such as alignment pins 25 or bolts 38, may be used for either the half-round shade 7 or the slanted side diffusion reflector shade 9 and are preferably located on the housing 10 so that either type shade can optionally be used with the same housing 10. Since the shade has both translucent and reflective properties, the "half round" shade of FIG. 6 allows light to diffuse upwardly and outwardly while reflecting light downwardly. The angled shade will permit light diffusion outwardly, and depending on whether it is slanting inwardly, as shown in FIG. 3, or outwardly, as shown in FIG. 1, as it extends from the top to bottom, will reflect light primarily upwardly toward the ceiling or downwardly away from the ceiling. The shade outer extremity is preferably closed with an end section 39 that is the same in appearance and character as that of the side shade 9. A lower flange 11 and an upper flange 37 can be provided on the shade end section 39 by either extrusion, welding or adhesive means. The flanges may be a white translucent or a clear plastic material. The upper flange 37 can rest upon the "U" shaped strut or support 18 and have a fastener 26 for positioning and holding the two together or as an alternative, a bracket can be attached to the end of the "U" shaped strut or support with a fastening means extending outwardly to engage, secure, support and position the shade end section. The fasteners may be metal or of a transparent or translucent material, to preclude dark spot production.

Figure 5:
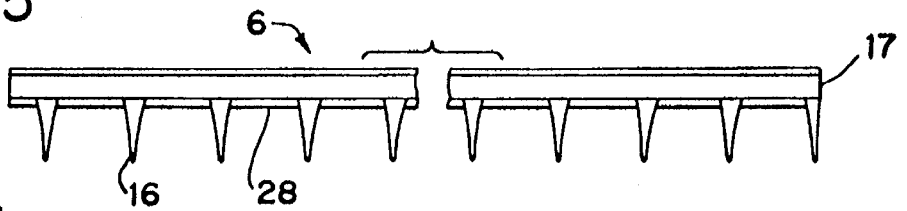
FIG. 5 is a partial side sectional view of the baffle shown in FIG. 4.

As shown in FIGS. 4 and 5, the baffle means 6 is composed of vertical sections that intersect at essentially right angles. The laterally extending sections 16 project downwardly further than the longitudinal section 28. The outermost end or edge sections or faces 17 are usually supported by flange means 11 attached to the lower portion of shade means 9. The flange means 11 can be extruded, as an integral part of the shade means 9 or 39, or may be of a transparent or translucent material glued or welded to the shade means 9 or 39. When positioned within the fixture, the baffle can be recessed, as shown in FIG. 7, or can extend downwardly. It is preferred that the baffle flanges 29 rest on the shade flange 11 with the baffle blades 16,28 extending downwardly. More specifically, it is preferred that the baffle extend downwardly so that its lowermost extent is even with the lower extent of the shade side, as shown in FIG. 3, or so that it is even with the lower extent of the ballast housing, as shown in FIG. 6. The height and spacing of the baffle blades provide for direct light cut off. Parabolic cross section blades have been found to better direct light down and out from the lamp fixture. The longitudinal baffle runner 28 can be omitted if desired and/or the lateral baffle runner 16 can be made flat or in a rectangular cross-section or other configuration.

The embodiment shown in FIG. 6 is a modification of that shown in FIGS. 1 and 3. The strut 18 forms a support along its top outward extent for a curved half-round or hemispherical translucent/reflector shade 7. The half-round shade 7 transmits a select portion of light upwardly onto the ceiling and outwardly to the sides, and reflects a select portion of light downwardly through the baffle means 6. In this manner, light is projected outwardly in all directions with the ratio of light projected downwardly to that projected upwardly and outwardly controlled by the reflection/diffusion ratio built into the various areas of the shade 7 along its length and around its periphery. The shade 7 may be provided with inwardly projecting flanges 27 that form supports for the baffle means 6. As with the flange 11, shown in FIG. 3, the flange 27 on the half-round shade 7 may be a flange such as that 11 secured to the shade by adhesive or other means. The baffle means is provided with flanges 29 that overlap and rest on the flanges 27 of the shade to support and position the baffle. The housing 10 is provided with alinement pins 25 or bolts 38 that support and/or position the inner end of the shade. The outer end of the shade can be open or it can be closed with the same material that the shade 7 is made of.

To support the lamps 2 at their outer ends, a bracket or clip 23, that can be considered a downward extension of the metallic strut 18, can be adjustably secured along the strut and attached to or extended under the lamps. The remote end of the strut 18 is secured to the remote portion or outer extension of the shade. The parts of the light fixture that extend outwardly, in a cantilever fashion, are relatively light and do not need the strong support necessary for metallic structures and lamps having opposite end electrical connections. The supports or clips 23 that support the outer ends of the lamps 2 prevent the lamp from falling and ensure that the lamp base maintains a positive contact with the electrical socket or outlet 21. The clip 23 may be of plastic or metal. The width of the clip should be minimal so as not to interfere with the thermal performance of the lamp. The clip should be located at an area about 60 to 75 percent of the distance from the lamp electrical attachment to the lamp outer extremity.

When more reflection is desired than that provided by the "U" strut 18, a generally concave or other shape reflector 24 can be provided over the lamp(s) as shown in FIG. 7. To prevent shadows above the light fixture, an opaque reflector having two parallel sections or two reflectors may be used, one over each lamp. The lamps 2 are optionally shown attached or mounted vertically or on edge. The reflector means 24 are arranged so that light from at least one of the lamps or lamp legs 2 shines upwardly to project onto all portions of the ceiling to preclude dark areas on the ceiling. The reflectors can be made from a metal or from a translucent/reflector non-metallic material. If the reflector means are made of metal, they can be used as the metallic strut support and start-up means. By using an adjustment plate 14 at the end of the reflector 24, with slot guide ways 15, the reflector can be slid along the guide way and turned or rotated to direct portions of the light in select directions. A single bolt-type fastener on the end of each reflector clamps the reflector connector 22 to the plate 14 permitting the adjustments. This adjustment, if a metal reflector, will have little effect on the ability of the reflector to support the lamp 2 and other parts cantilevered from the housing 10. The reflector 24, with or without an adjustable connector 22, can be located centrally to replace, for example, the strut 18 shown in FIG. 6. The width of the struts 18 and concave reflectors 24 and distance they are placed above the lamps in part determines the amount of light that reaches the ceiling.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

I claim:

1. A supported illumination fixture including:

a housing for a ballast means and electric circuit means;

a non-metallic diffusion means extending outwardly from said housing;

a lamp means extending outwardly from said housing;

a metallic support secured to and extending outwardly from said housing and generally parallel to said lamp means;

an electric conduction path between said housing and ground;

said metallic support electrically connected into said electric conduction path to ground said metallic support and assist start-up of said lamp means.

2. A supported illumination fixture as described in claim 1 including:

said ballast means within said housing extending perpendicular to said lamp means.

3. A supported illumination fixture as described in claim 1 including:

said lamp means being elongated and having electrical connectors at the same end and having a cantilever attachment to said housing.

4. A supported illumination fixture as described in claim 3 including:

said ballast means within said housing extending perpendicular to said lamp means.

5. A supported illumination fixture as described in claim 1 wherein:

said lamp means includes lamps that extend parallel to each other;

said metallic support means arranged with respect to said pair of lamps such that a portion of the light from said pair of lamps is permitted to illuminate the entire area above said lamps while the remaining portion is reflected downwardly and outwardly.

6. A supported illumination fixture as described in claim 3 wherein:

non-metallic means are provided for supporting a baffle under said lamp means;

said non-metallic means are light transmitting to prevent the formation of dark areas by said illuminating fixture.

7. A supported illumination fixture as described in claim 6 wherein:

said metallic support is supported cantilever fashion to said housing and is attached to the outer portion of said non-metallic support and diffusion means.

8. A supported illumination fixture as described in claim 3 wherein:

said illumination fixture includes lamps that extend from opposite sides of said housing to balance the torque placed on said housing by said lamps.

9. A supported illumination fixture as described in claim 8 wherein:

said housing means is supported from the ceiling by suspension means that attach to the upper portion of said housing;

adjustment means are provided on said suspension means for leveling or adjusting the position of said illumination fixture with respect to the ceiling and floor.

10. A supported illumination fixture as described in claim 1 wherein:

said non-metallic diffusion means extends over three sides of said lamp means to control the dispersion of light from said lamp means.

11. A supported illumination fixture as described in claim 10 wherein:

said non-metallic diffusion means is in the form of a curved shade.

12. A supported illumination fixture including:

a metallic housing for a ballast means and electric circuit means;

a lamp means extending outwardly from said housing in opposite directions to balance the forces on said housing;

said lamp means having electrical connectors at the same end and having a cantilever attachment to said housing;

said ballast means within said housing being in heat conducting relationship with said metallic housing so that air circulation around said housing removes the heat generated by said ballast means;

a diffusion and reflection means extending outwardly from said housing with said lamp means being within said diffusion and reflection means;

a support attached to and extending outwardly from said housing and generally parallel to said lamp means.

13. A supported illumination fixture as described in claim 12 wherein:

said support is a metallic reflector that extends above said lamp means and is attached to said housing by a connector that permits said metallic reflector to be adjusted with respect to said lamp means to control the direction the light from said lamp means is reflected in.

14. A supported illumination fixture as described in claim 13 wherein:

said metallic reflector support is grounded to assist start up of said lamp means.

15. A supported illumination fixture as described in claim 13 wherein:

said metallic reflector connector includes a fastener that permits said metallic reflector to be moved horizontally and to be rotated to adjust and control the direction the upwardly projected light from said lamp means is reflected in.

16. A supported illumination fixture as described in claim 12 wherein:

said central housing is supported by four support stems that are each adjustable vertically so that the height and orientation of the fixture extremities can all be adjusted relative to one another in the vertical direction.

17. A supported illumination fixture as described in claim 12 wherein:

said diffusion and reflection means are positioned against said metallic housing at one end and are supported at their other end by said support;

a baffle means is supported under said lamp means by said diffusion and reflection means.

18. A supported illumination fixture as described in claim 12 wherein:

said diffusion and reflective means extend beyond said lamp means and are in the form of lightweight plastic side and end shade sections having diffusion grooves.

19. A supported illumination fixture as described in claim 12 wherein:

said diffusion and reflective means are in the form of curved lightweight plastic shades that extend over said support and downwardly over and around the sides of said lamp means.

20. A supported illumination fixture as described in claim 12 wherein:

translucent means are provided at the ends of said diffusion and reflection means such that light projects outwardly from said lamp means sides and ends with no opaque or dark areas.

* * * * *